US012274387B2

(12) United States Patent
Haase

(10) Patent No.: US 12,274,387 B2
(45) Date of Patent: Apr. 15, 2025

(54) DEVICE FOR GETTING SOCKS ON

(71) Applicant: Barzetti Welding LLC, Bethel, CT (US)

(72) Inventor: Harold Haase, Newtown, CT (US)

(73) Assignee: BARZETTI WELDING LLC, Bethel, CT (US)

( * ) Notice: Subject to any disclaimer, the term of this patent is extended or adjusted under 35 U.S.C. 154(b) by 0 days.

(21) Appl. No.: 18/772,632

(22) Filed: Jul. 15, 2024

(65) Prior Publication Data

US 2025/0024974 A1 Jan. 23, 2025

Related U.S. Application Data

(60) Provisional application No. 63/527,914, filed on Jul. 20, 2023.

(51) Int. Cl.
*A47G 25/90* (2006.01)

(52) U.S. Cl.
CPC ..... *A47G 25/905* (2013.01)

(58) Field of Classification Search
CPC ..... A47G 25/905; A47G 25/90; A47G 25/908
(Continued)

(56) References Cited

U.S. PATENT DOCUMENTS 3,692,217 A 9/1972 Smith
3,715,065 A 2/1973 Peck
(Continued)

FOREIGN PATENT DOCUMENTS

AU 2003100774 B4 11/2003
DE 4438319 C2 2/1999
(Continued)

OTHER PUBLICATIONS

"Sock Slider"; allstarinnovationsstore.com; Accessed Jul. 22, 2023; https://www.allstarinnovationsstore.com/products/sock-slider.
(Continued)

*Primary Examiner* — Nathan E Durham
(74) *Attorney, Agent, or Firm* — WARE, FRESSOLA, MAGUIRE & BARBER LLP

(57) ABSTRACT

A device for assisting a person in getting a sock onto their foot features a handle connected to two blades. The handle has a middle and two ends, the middle being configured to be held by a person's hand who is getting a sock on their foot. The blades have substantially similar shapes and dimensions. Each blade has a side member and a blade member. Each side member has a top portion connected to a respective end of the handle and also having a front side member surface. Each blade member having a blade profile with a blade slot surface, a top curved/radii profile, a front blade surface and a bottom blade surface. Each front side member surface and each blade slot surface is dimensioned and angled to form a respective blade slot between each side member and each blade member configured to receive a top portion of the sock. Each top curved/radii profile is configured to allow the top portion of the sock to slide onto each blade member and into each blade slot so that each blade engages and holds the top portion of the sock when the person pulls the sock onto their foot and also releases the top portion of the sock once the person gets the sock on their foot and rotates the device upwardly away from the sock.

16 Claims, 8 Drawing Sheets

(58) Field of Classification Search
USPC ..... 223/112–113
See application file for complete search history.

(56) References Cited

U.S. PATENT DOCUMENTS

| | | | | |
|---|---|---|---|---|
| 4,651,909 | A | 3/1987 | Banting | |
| 4,789,087 | A | 12/1988 | Doorenbos | |
| 5,249,720 | A | 10/1993 | White | |
| 5,894,970 | A | 4/1999 | Belkin et al. | |
| 5,909,831 | A * | 6/1999 | Griffin | A47G 25/905 223/111 |
| 6,056,171 | A | 5/2000 | Santamaria | |
| 6,942,129 | B2 | 9/2005 | Ferraioli | |
| 8,919,620 | B2 | 12/2014 | Taylor et al. | |
| 9,161,646 | B2 | 10/2015 | Bertinotti | |
| 9,498,077 | B2 | 11/2016 | Carlson et al. | |
| 9,681,767 | B1 | 6/2017 | Barker et al. | |
| 11,375,836 | B2 | 7/2022 | Lopez | |
| D1,047,353 | S * | 10/2024 | Lopez | D3/17 |
| 2002/0139819 | A1* | 10/2002 | Ferraioli | A47G 25/908 223/111 |
| 2007/0062986 | A1 | 3/2007 | Doud | |
| 2015/0136816 | A1 | 5/2015 | Aparicio | |
| 2019/0314237 | A1* | 10/2019 | Lopez | A47G 25/907 |
| 2022/0117425 | A1* | 4/2022 | Lopez | A47G 25/908 |

FOREIGN PATENT DOCUMENTS

| | | | |
|---|---|---|---|
| EP | 0 832 589 | A2 | 4/1998 |
| FR | 2712162 | A1 | 5/1995 |
| IT | 202100010163 | A1 | 10/2022 |

OTHER PUBLICATIONS

"Stauber Best Sock Aid and Shoe Horn—Hinged Sock Aid and New Extra Long Handled Shoe Horn—Design for post surgery"; stauberbest.com; Accessed Jul. 22, 2023; https://stauberbest.com/products/sockaidandshoehorn.

"Sock Ox Sock Aid"; easytouseproducts.com; Accessed Jul. 22, 2023; https://www.easytouseproducts.com/sockox/.

"Sock/Stocking Aid"; able2.uk; Accessed Jul. 20, 2023; https://able2.uk/product/pr55319/socksocking-aid.

English language translation of IT202100010163A1.

English language translation of FR2712162A1.

English language translation of DE4438319C2.

* cited by examiner

DEVICE FOR GETTING SOCKS ON

CROSS-REFERENCE TO RELATED APPLICATIONS

This application claims benefit to provisional application Ser. No. 63/527,914, filed 20 Jul. 2023, which is hereby incorporated by reference in its entirety.

BACKGROUND OF THE INVENTION

You can reach further in front of yourself with one hand than you can with two hands together. Because of this truth, many adults find difficulty in getting their socks on, since their reach is limited when using two hands together.

SUMMARY OF INVENTION

A small, simple, one piece, hand-held device that allows a user to quickly and comfortably get a sock on by employing the benefit of the user's enhanced reach when using just one hand.

Most sock aids currently available are primarily intended for use by physically compromised individuals. They are larger, more complicated and work more slowly than the subject device, which is intended for general use. The subject device works very quickly. A regular user can reliably get a sock on a foot in less than five seconds.

The subject device is made up of three components: The blades upon which the sock is mounted, the side members that connect the blades to the handle, and the handle. The design length of the handle spreads the blades to straddle an adult foot while also serving as a convenient crossmember for grasping the device during use.

To use the device, a sock cuff is stretched across the two blades and then pulled onto the foot in one motion.

Specific Embodiments

The present invention provides a device for assisting a person in getting a sock onto the person's foot, featuring a handle connected to two blades.

The handle has a middle and two ends, the middle being configured to be held by a person's hand who is getting a sock on the person's foot.

The two blades have substantially similar shapes and dimensions. Each blade has a side member and a blade member. Each side member has a top portion connected to a respective end of the handle and also having a front side member surface. Each blade member having a blade profile with a blade slot surface, a top curved/radii profile, a front blade surface and a bottom blade surface. Each front side member surface and each blade slot surface is dimensioned and angled to form a respective blade slot between each side member and each blade member configured to receive a top portion of the sock. Each top curved/radii profile is configured to allow the top portion of the sock to slide onto each blade member and into each blade slot so that each blade engages and holds the top portion of the sock when the person pulls the sock onto their foot and also releases the top portion of the sock once the person gets the sock on the person's foot and rotates the device upwardly away from the sock.

The device may also include one or more of the following features:

The device may be an integral one piece unit, as well as the handle and the two blades being separate pieces.

The device may be made from either plastic or metal.

The handle may have a length of about four (4) inches to allow the foot of the person to slide inbetween the blades for pulling the sock on the foot of the person, e.g., which may include a range of about 3.5-4.5 inches.

Each blade slot may be configured with a respective angle of about 15°, e.g., which may include a range of about 5°-25°.

Each blade slot surface and each front blade surface of each blade member may be configured at an angle of about 45°, e.g., which may include a range of about 35°-55°.

Each front blade surface and each bottom blade surface of each blade member may be configured at an angle of about 45°, e.g., which may include a range of about 35°-55°.

Each blade profile may include a front curved/radii profile coupling the front blade surface and each bottom blade surface.

Each blade slot may include a blade slot bottom surface coupling each blade slot surface and each front side member surface.

Each side member has a top-to-bottom length of about three (3) inches, e.g., which may include a range of about 2.5-3.5 inches.

Each blade may include a front-to-back length length of about three (3) inches, e.g., which may include a range of about 2.5-3.5 inches.

Each side member may include a back side member surface; and each blade member may include a back curved/radii profile coupling each back side member surface and each bottom blade surface.

Each bottom blade surface and each back side member surface may be substantially perpendicular to each other.

The handle and the blades may be arranged substantially perpendicular to each other.

DETAILED DESCRIPTION

Figure 7A:
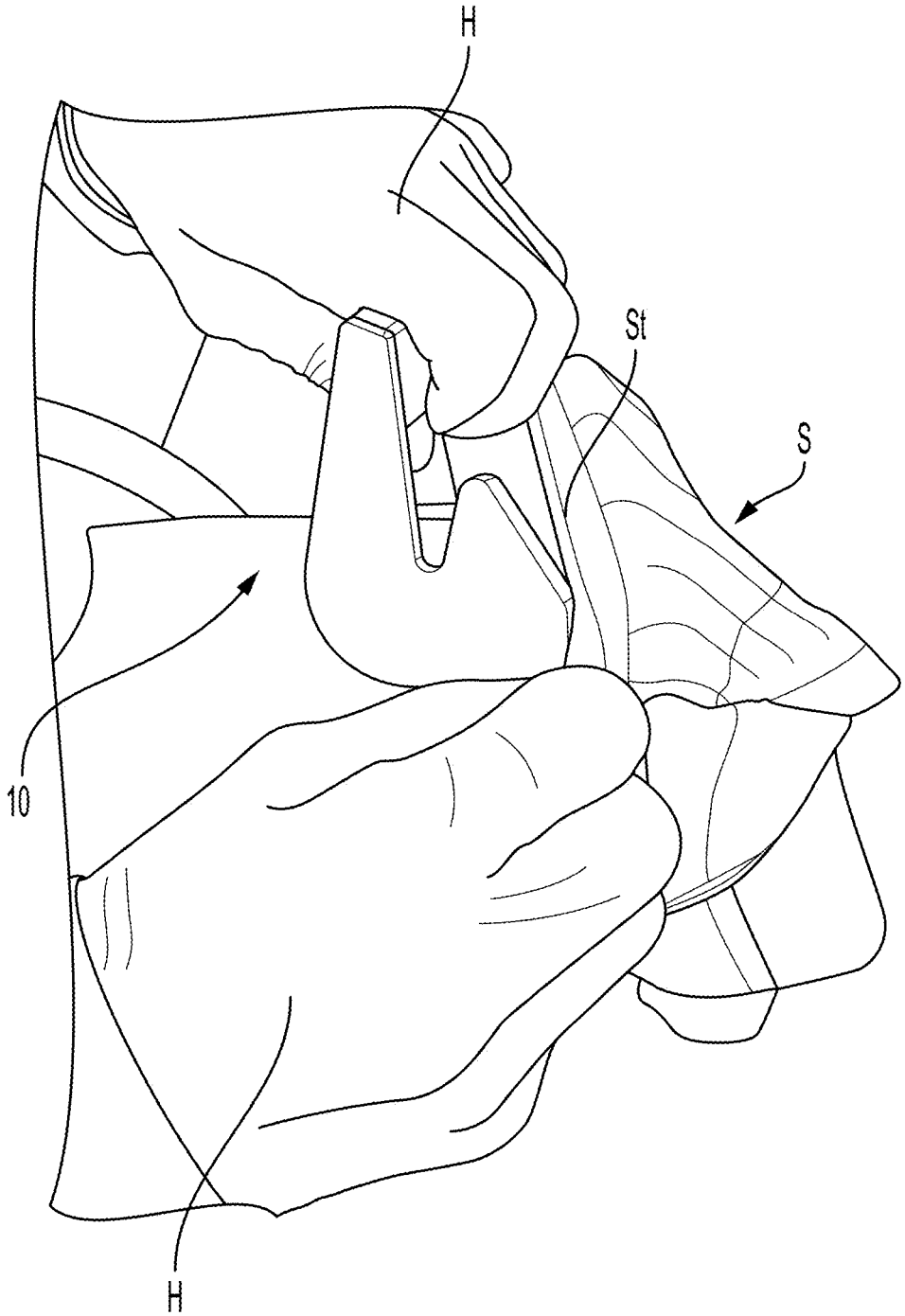
FIG. 7A is a photograph of a person using the device shown in FIG. 3 for assisting the person in getting a sock onto the person's foot, according to some embodiments of the present invention.
Figure 7B:
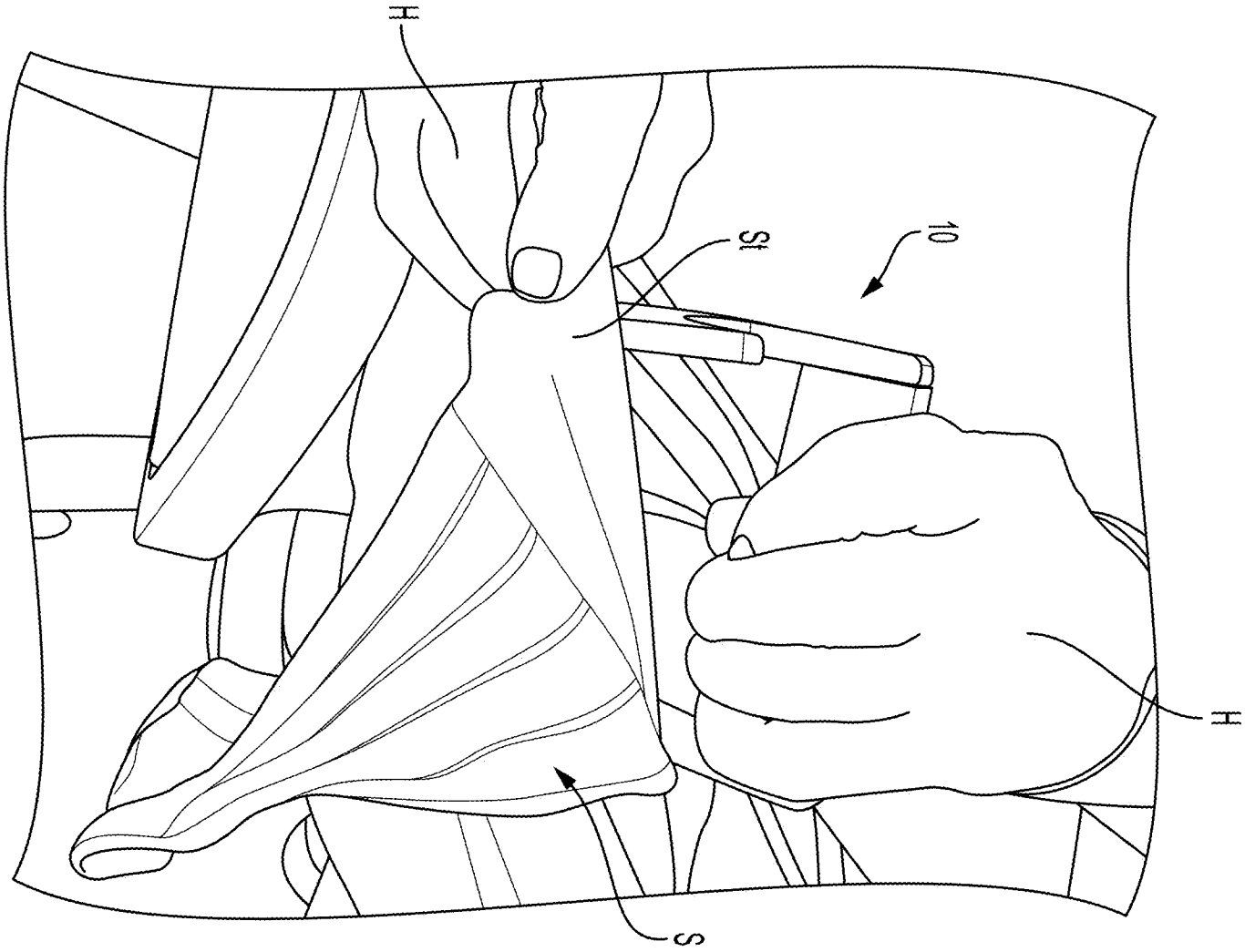
FIG. 7B is a photograph of a person using the device shown in FIG. 3 for assisting the person in getting a sock onto the person's foot, according to some embodiments of the present invention.
Figure 8:
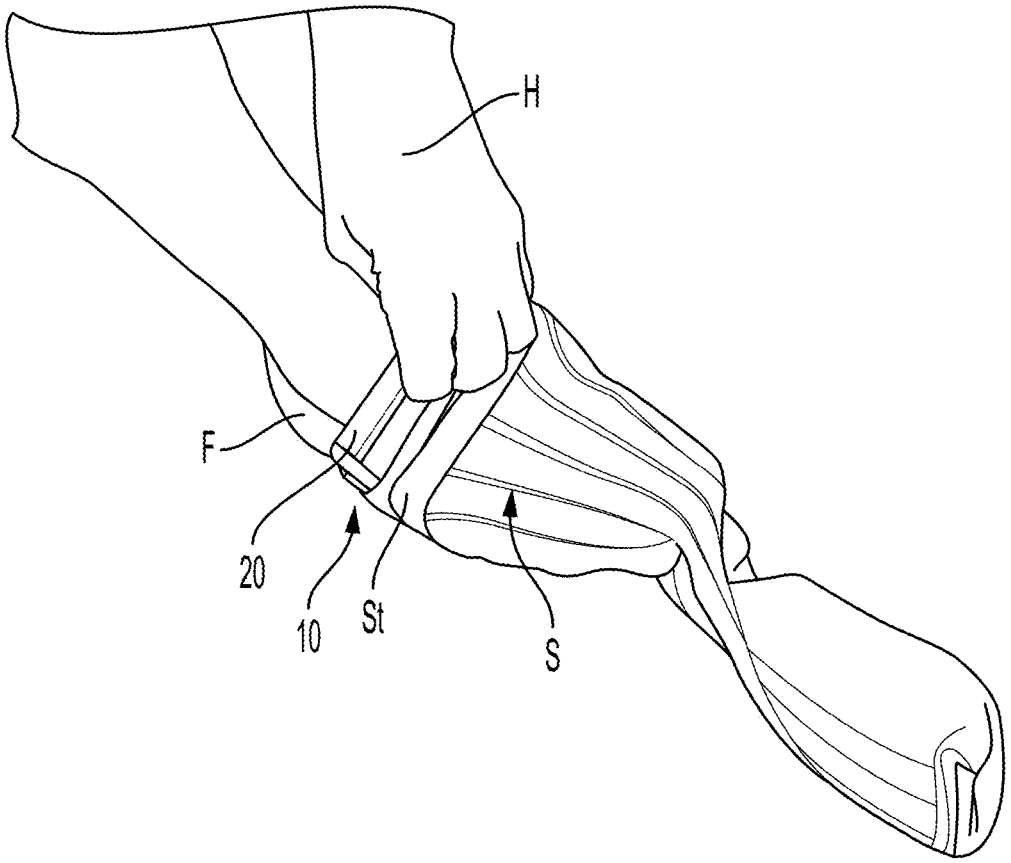
FIG. 8 is a photograph of a person using the device shown in FIG. 3 for assisting the person in getting a sock onto the person's foot, according to some embodiments of the present invention.

The present invention provides a device generally indicated as 10 (FIGS. 1-6) having a top-to-bottom axis (A) and configured for assisting a person in getting a sock S (FIGS. 7A and 7B) onto the person's foot F (FIG. 8). The device 10 includes a handle 20 connected to two blades 30.

The handle 20 has a middle 22 and two ends 24*a*, 24*b*. The middle 22 is configured to be held by a person's hand H (FIGS. 7A, 7B and 8) who is getting the sock S on the person's foot F.

Figure 2:
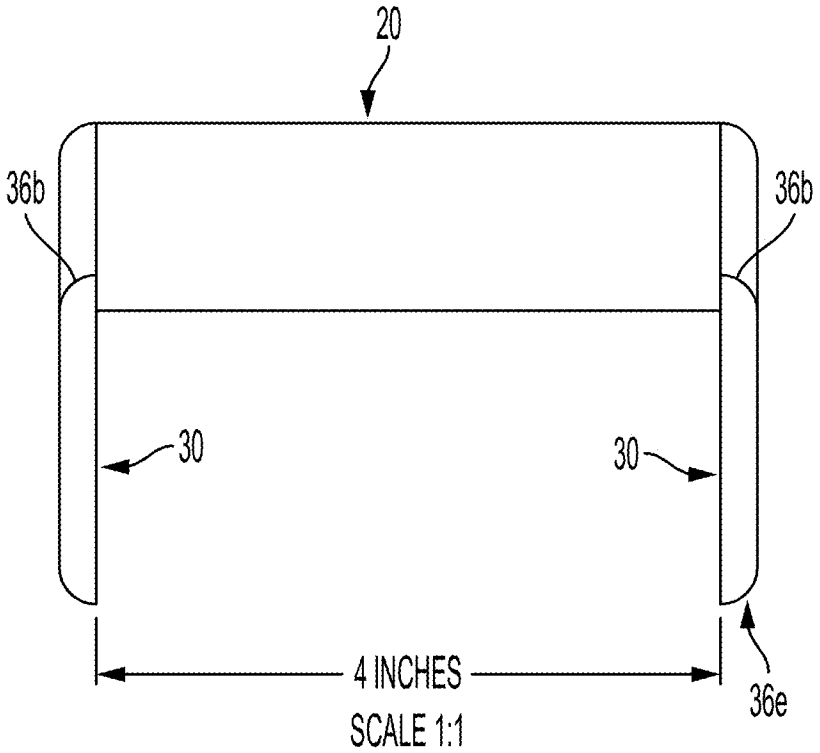
FIG. 2 is a diagram of a front view of the device shown in FIG. 1 for assisting a person in getting a sock onto the person's foot, according to some embodiments of the present invention.
Figure 1:
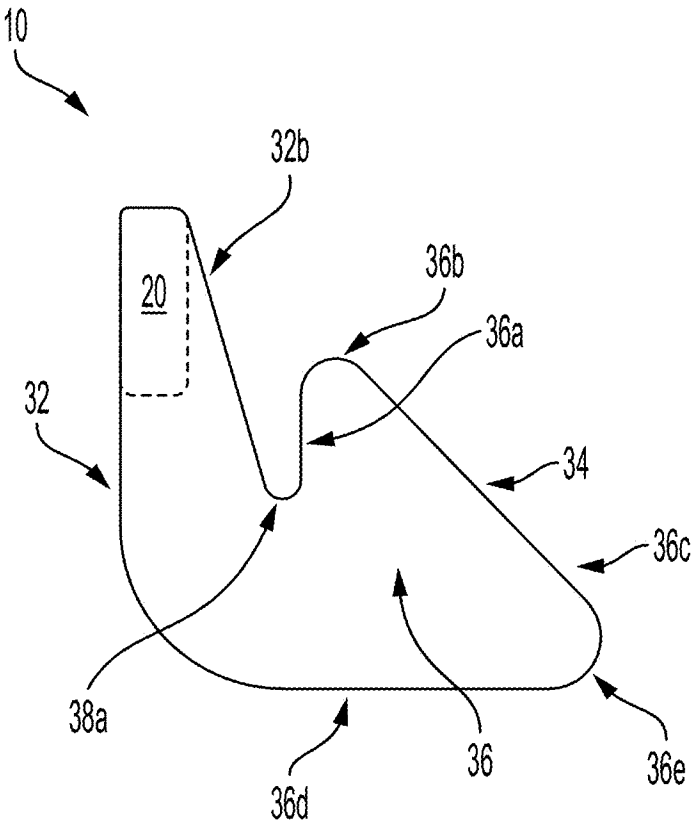
FIG. 1 is a diagram of one of two symmetric blades connected to a handle shown in phantom of a device for assisting a person in getting a sock onto the person's foot, according to some embodiments of the present invention.
Figure 3:
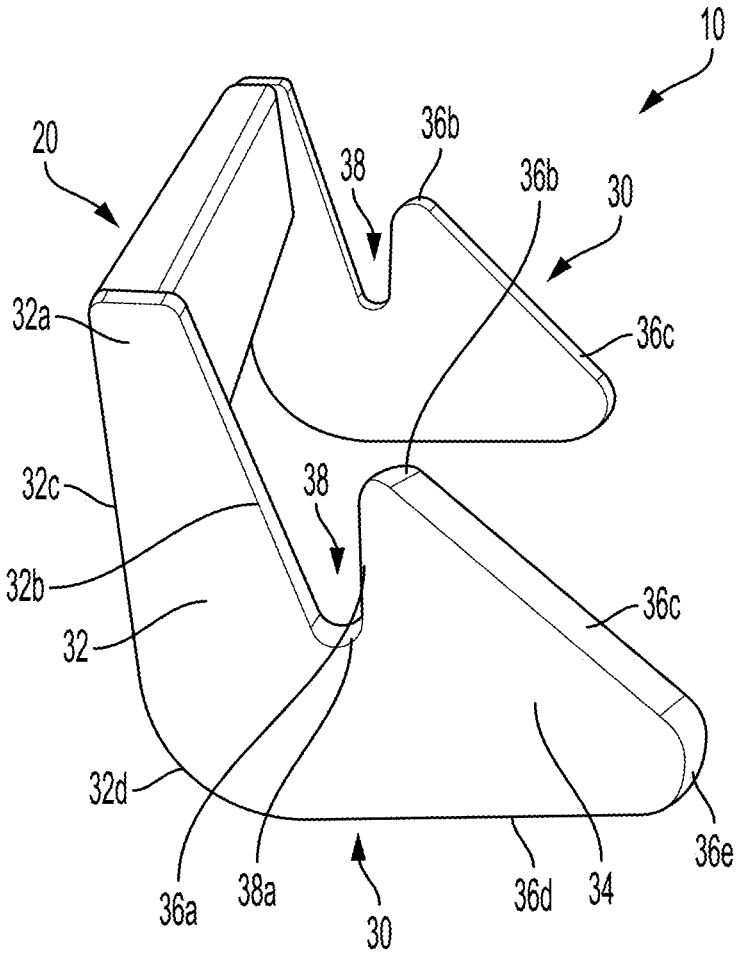
FIG. 3 is a photograph having a side perspective view of a device for assisting a person in getting a sock onto the person's foot, according to some embodiments of the present invention.
Figure 4:
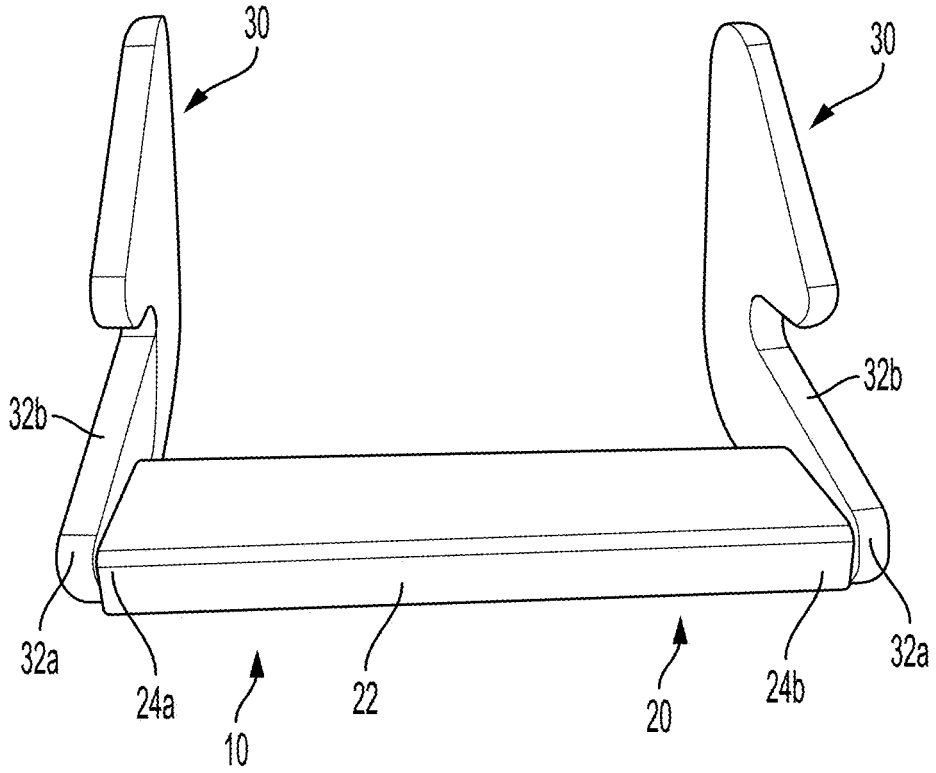
FIG. 4 is a photograph having a top view of the device shown in FIG. 3 for assisting a person in getting a sock onto the person's foot, according to some embodiments of the present invention.
Figure 5:
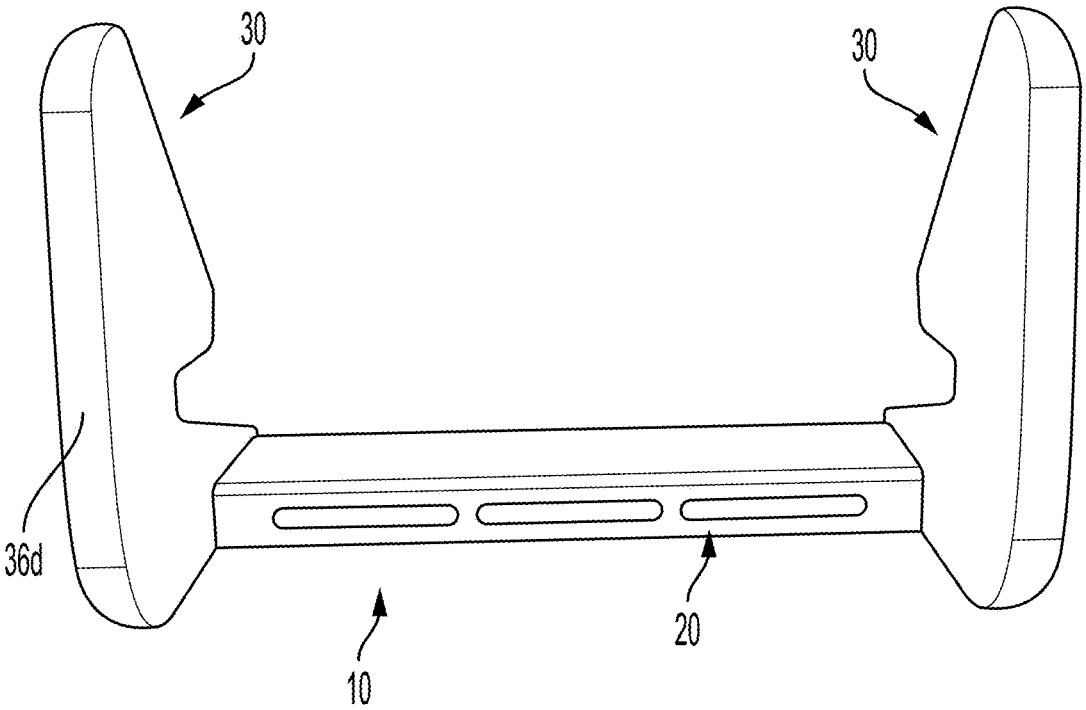
FIG. 5 is a photograph having a bottom view of the device shown in FIG. 3 for assisting a person in getting a sock onto the person's foot, according to some embodiments of the present invention.
Figure 6:
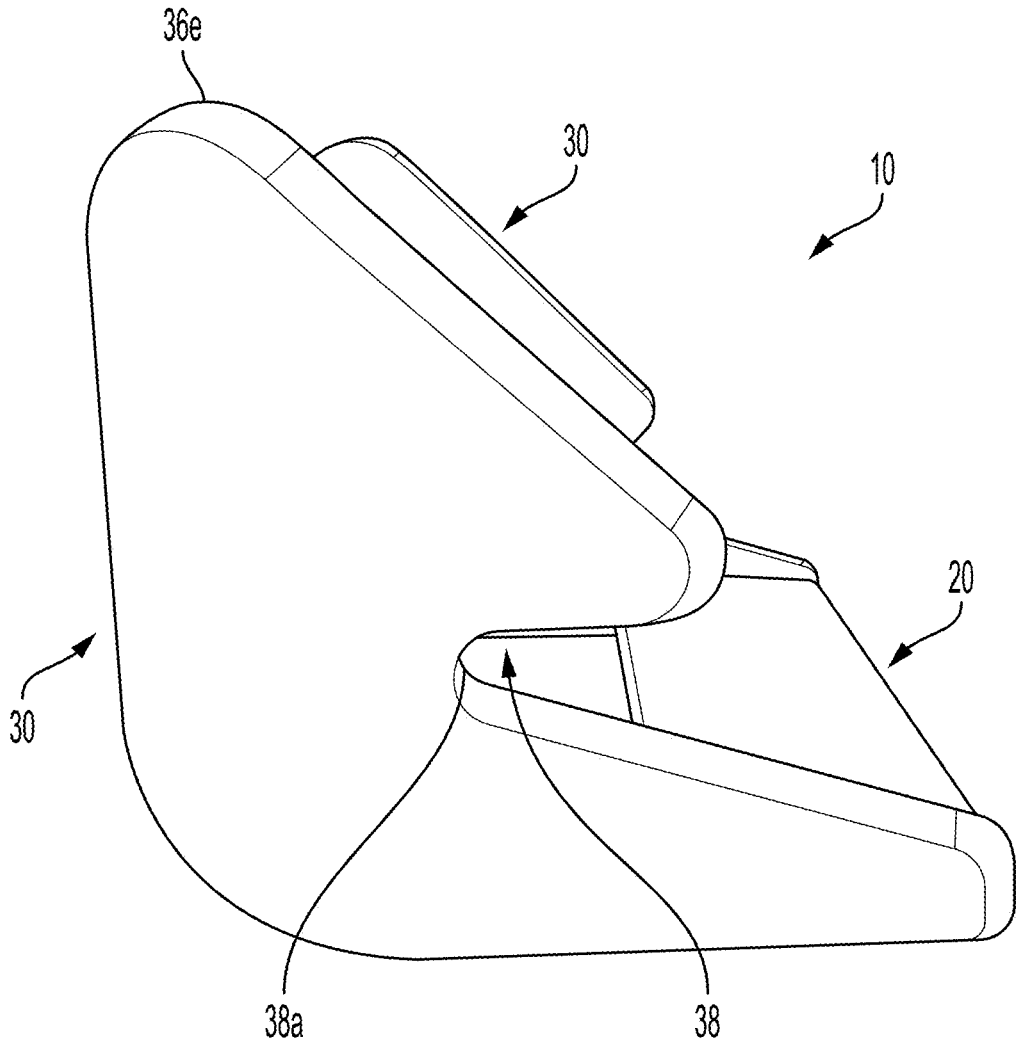
FIG. 6 is a photograph having a side perspective view of the device shown in FIG. 3 for assisting a person in getting a sock onto the person's foot, according to some embodiments of the present invention.

The two blades 30 have substantially similar shapes and dimensions, e.g., as shown in FIGS. 3-5. Each blade 30 has two portion, e.g., including a side member 32 and a blade member 34.

Each blade member 34 has a respective blade profile 36 (FIG. 1), e.g., having a blade slot surface 36*a*, a top curved/radii profile 36*b*, a front blade surface 36*c* and a bottom blade surface 36*d*, e.g., as labeled and best shown in FIG. 3. Each front side member surface 32*b* and each blade slot surface 36*a* are dimensioned and angled to form a respective blade slot 38 between each side member 32 and each blade member 34, e.g., as shown in FIGS. 3-6. Each blade slot 38 is configured to receive a top portion St of the sock S, e.g., as shown in FIGS. 7A and 7B . . . . Each top curved/radii profile 36*b* is configured to allow the top portion St of the sock S to slide onto each blade member 34 and into each blade slot 38 so that each blade 30 engages and holds the top portion St of the sock S when the person pulls the sock S onto the person's foot F and also releases the top portion St of the sock S once the person gets the sock S on the person's foot F and rotates the device 10 upwardly away from the sock S.

Each blade profile 36 may also include a front curved/radii profile 36*e* coupling the front blade surface 36*c* and the bottom blade surface 36*d*. The front curved/radii profile 36*e* is shown having a curved surface; however, the scope of the invention is not intended to be limited to any particular curvature.

Each blade slot 38 may also include a blade slot bottom surface 38*a* coupling each blade slot surface 36*a* and each front side member surface 32*b*. The blade slot bottom surface 38*a* is shown having a curved surface; however, the scope of the invention is not intended to be limited to any particular curvature.

Each side member 32 may also include a back side member surface 32*c*; and each blade member 34 may also include a back curved/radii profile 32*d* coupling each back side member surface 32*c* and each bottom blade surface 36*d*. The back curved/radii profile 32*d* is shown having a curved surface; however, the scope of the invention is not intended to be limited to any particular curvature.

Each bottom blade surface 36*d* and each back side member surface 32*d* may be substantially perpendicular to each other, e.g., as best shown in FIGS. 1, 3 and 5-6.

The handle 20 and the blades 30 may be arranged substantially perpendicular to each other, e.g., as best shown in FIGS. 2-5.

Other Design Details

The device may also include one or more of the following features:

The profile 36*e* at the front of the blades 30 are sized and radiused to allow easy entry into a sock cuff without snagging or damaging the sock fabric.

The vertical dimension from the bottom of the slots 38 to the bottom of the device 10, combined with the span between the blades 34, create a desired rectangular opening necessary to reliably accommodate adult foot sizes.

The top-to-bottom height of the blades 30, combined with their distance apart, e.g., which is about 4 inches, are intentionally sized to approximately duplicate the stretch that sock fabrics endure when manually pulled around the heel of an adult foot. While the preferred embodiment is disclosed having a distance about 4 inches, the scope of the invention is not intended to be limited to any particular distance per se. For example, embodiments are envisioned, and the scope of the invention is intended to includes distances that are less than about 4 inches, e.g., such as 3.75 inches, 3.50 inches, 3.25 inches and 3.00 inches, as well as distances that are more less than about 4 inches, e.g., such as 4.25 inches, 4.50 inches, 4.75 inches and 5.00 inches.

The front-to-back length of the blades 30, combined with the design stretch of the sock cuff, restrain the mounted sock S (FIGS. 7A, 7B and 8) from prematurely sliding off the bottom front of the blades 34 as the sock S is pulled onto the foot F.

The profile radii 36*b* on the top of the blades 30 are sized and dimensioned to prevent damage to the sock fabric during the release of the device 10 from the sock 10.

The full radii designed into the outside edges of both blades 30 allows extensive use of the device 10 without damage to the stretched sock fabric.

The design width of the slots 38 are sized and dimensioned to accommodate all current sock styles, including thick woolen socks.

The design length of the slots 38, combined with the design stretch of the mounted sock cuff, hold the sock cuff securely preventing premature release of the sock S from the device 10.

Intentional release of the device 10 from the sock S is accomplished by rotating the handle 20 away from the user which tilts the slots 38 and permits the device 10 to free itself from the sock S.

The device 10 according to the present invention has a sensitive design, which includes both criticality in relation to the various dimensions themselves, as well as corresponding criticality in relation to the various dimensions in combination with one another. In other words, without the cooperative interconnection of all the following design details, the device 10 will not function satisfactorily. For example, if the length of the handle H is too long, then most adult socks will not be able to be stretched far enough to be held onto the device 10. By way of further example, if the length of the handle H is too short, then most adult feet will not be able to fit inbetween the blades 30 to pull the sock S onto a foot F.

The invention claimed is:

1. A device (10) having a top-to-bottom axis (A) and configured for assisting a person in getting a sock (S) onto a foot of the person (F), comprising:

a handle (20) having a middle (22) and two ends (24*a*, 24*b*), the middle (22) being configured to be held by a hand of the person (H) who is getting the sock (S) on the person's foot (F); and blades (30) having substantially similar shapes and dimensions, each blade (30) having a side member (32) and a blade member (34), each side member (32) having a top portion (32*a*) connected to a respective end (24*a*, 24*b*) of the handle (20), having a front side member surface (32*b*) extending obliquely to the top-to-bottom axis (A) of the device (10), and having a back side member surface (32*c*) extending substantially parallel to the top-to-bottom axis (A) of the device (10), each blade member (34) having a blade profile (36) with a blade slot surface (36*a*) extending substantially parallel to the top-to-bottom axis (A) of the device (10), a top curved/radii profile (36*b*), a front blade surface (36*c*) extending obliquely to the top-to-bottom axis (A) of the device (10) and a bottom blade surface (36*d*) extending substantially transverse to the blade slot surface (36*a*), each front side member surface (32*b*) and each blade slot surface (36*a*) being dimensioned and angled to form a respective blade slot (38) between each side member (32) and each blade member (34) configured to receive a top portion (St) of the sock (S), each top curved/radii profile (36*b*) being configured to allow the top portion (St) of the sock (S) to slide onto each blade member (34) and into each blade slot (38) so that each blade (30) engages and holds the top portion (St) of the sock (S) when the person pulls the sock (S) onto the person's foot (F) and also releases the top portion (St) of the sock (S) once the person gets the sock (S) on the person's foot (F) and rotates the device (10) upwardly away from the sock (S).

2. A device (10) according to claim 1, wherein the device (10) is an integral one piece unit.

3. A device (10) according to claim 1, wherein the device (10) is made from either plastic or metal.

4. A device (10) according to claim 1, wherein the handle (10) has a length to allow the foot (F) of the person to slide inbetween the blades (30) for pulling the sock (S) on the foot (F) of the person, the length being in a range of about 3.5-4.5 inches.

5. A device (10) according to claim 1, wherein each blade slot (38) is configured with a respective angle in a range of about 5°-25°.

6. A device (10) according to claim 1, wherein each blade slot surface (36*a*) and each front blade surface (36*c*) of each blade member (34) are configured at an angle in a range of about 35°-55°.

7. A device (10) according to claim 1, wherein each front blade surface (36*c*) and each bottom blade surface (36*d*) of each blade member (34) are configured at an angle in a range of about 35°-55°.

8. A device (10) according to claim 1, wherein each blade profile (36) includes a front curved/radii profile (36*e*) coupling each front blade surface (36*c*) and each bottom blade surface (36*d*).

9. A device according to claim 1, wherein the front curved/radii profile (36*e*) is sized and radiused to allow easy entry into a sock cuff without snagging or damaging fabric of the sock.

10. A device (10) according to claim 1, wherein each blade slot (38) includes a blade slot bottom surface (38*a*) coupling each blade slot surface (36*a*) and each front side member surface (32*b*).

11. A device (10) according to claim 1, wherein each side member (32) has a top-to-bottom length extending along the back side member surface (32*c*) in a range of about 2.5-3.5° inches.

12. A device (10) according to claim 1, wherein each blade (34) has a front-to-back length length extending along the bottom blade surface (36*d*) in a range of about 2.5-3.5° inches.

13. A device (10) according to claim 1, wherein each blade member (34) has a back curved/radii profile (32*d*) coupling each back side member surface (32*c*) and each bottom blade surface (36*d*).

14. A device (10) according to claim 1, wherein each bottom blade surface (36*d*) and each back side member surface (32*c*) are substantially perpendicular to each other.

15. A device (10) according to claim 1, wherein the device (10) has a rectangular opening necessary to reliably accommodate adult foot sizes formed by a combination of a vertical dimension from blade slots (38) together with a span between the blades (30).

16. A device (10) according to claim 1, wherein the blades (30) have a height and are separated by a, distance to approximately duplicate a stretch of a sock's fabric when manually pulled around a heel of an adult foot.

* * * * *